US011798389B2

(12) United States Patent
Docherty et al.

(10) Patent No.: US 11,798,389 B2
(45) Date of Patent: Oct. 24, 2023

(54) PORTABLE MONITORING UNIT

(71) Applicant: DRAEGER SAFETY UK LIMITED, Northumberland (GB)

(72) Inventors: James Docherty, Northumberland (GB); Greg Barber, Northumberland (GB); Matthew Barnes, Morpeth (GB); Conor Carr, Tyne and Ware (GB)

(73) Assignee: DRAEGER SAFETY UK LIMITED, Northumberland (GB)

( * ) Notice: Subject to any disclaimer, the term of this patent is extended or adjusted under 35 U.S.C. 154(b) by 0 days.

(21) Appl. No.: 16/963,879

(22) PCT Filed: Jan. 31, 2019

(86) PCT No.: PCT/GB2019/050270
§ 371 (c)(1),
(2) Date: Jul. 22, 2020

(87) PCT Pub. No.: WO2019/150118
PCT Pub. Date: Aug. 8, 2019

(65) Prior Publication Data

US 2021/0043057 A1 Feb. 11, 2021

(30) Foreign Application Priority Data

Feb. 2, 2018 (GB) ..... 1801751

(51) Int. Cl.
*G08B 23/00* (2006.01)
*G08B 21/04* (2006.01)

(52) U.S. Cl.
CPC ..... *G08B 21/0415* (2013.01)

(58) Field of Classification Search
CPC ..... G08B 21/0415
USPC ..... 340/573.1
See application file for complete search history.

(56) References Cited

U.S. PATENT DOCUMENTS

| | | | | |
|---|---|---|---|---|
| 4,906,972 | A | 3/1990 | Spencer | |
| 5,640,148 | A | 6/1997 | Lewis et al. | |
| 7,263,379 | B1 * | 8/2007 | Parkulo | A62B 9/006 370/254 |
| 2005/0172959 | A1 * | 8/2005 | Williams | H04B 1/385 128/201.19 |
| 2006/0201509 | A1 * | 9/2006 | Forsyth | A62B 7/08 128/204.26 |

(Continued)

FOREIGN PATENT DOCUMENTS

| | | | |
|---|---|---|---|
| EP | 2674924 | A1 | 12/2013 |
| WO | 2015081043 | A1 | 6/2015 |

OTHER PUBLICATIONS

International Search Report, dated Apr. 15, 2019, issued in International Application No. PCT/GB2019/050270.

*Primary Examiner* — Naomi J Small
(74) *Attorney, Agent, or Firm* — Saul Ewing LLP

(57) ABSTRACT

A portable monitoring unit for personnel working in hazardous environments, including a coupling to which an auxiliary unit can be structurally coupled; a motion sensor; an alert generator which is configured to generate an alert when motion is not detected for a period of time; and a power interface arranged to receive power for the portable monitoring unit from a power interface of the auxiliary unit when the auxiliary unit is structurally coupled to the portable monitoring unit.

22 Claims, 2 Drawing Sheets

(56) References Cited

U.S. PATENT DOCUMENTS

| | | | | |
|---|---|---|---|---|
| 2007/0023045 | A1* | 2/2007 | Kwok | A61M 16/0057 128/204.23 |
| 2009/0023421 | A1 | 1/2009 | Parkulo et al. | |
| 2013/0319408 | A1* | 12/2013 | Zwolinsky | A62B 18/02 128/204.21 |
| 2016/0001111 | A1* | 1/2016 | Morgan | A62B 18/082 128/205.12 |
| 2017/0182267 | A1* | 6/2017 | Cameron | A61M 11/042 |
| 2017/0296094 | A1* | 10/2017 | Fonzi, III | A61B 5/0002 |
| 2018/0131847 | A1* | 5/2018 | Kokonaski | H02J 50/10 |
| 2019/0086378 | A1* | 3/2019 | Holdcroft | G01N 33/0009 |
| 2019/0151686 | A1* | 5/2019 | Springer | G05D 7/0676 |
| 2021/0008312 | A1* | 1/2021 | Young | A61M 16/021 |

* cited by examiner

PORTABLE MONITORING UNIT

CROSS REFERENCE TO RELATED APPLICATIONS

This application claims the priority of PCT/GB2019/050270, filed on Jan. 31, 2019, which claims priority to Great Britain Application No. 1801751.7, filed on Feb. 2, 2018, the entire contents of which are incorporated fully herein by reference.

BACKGROUND OF THE INVENTION

The present invention relates to a portable monitoring unit.

Breathing apparatus, such as self-contained breathing apparatus (SCBA), is frequently used by persons working in hazardous environments. Breathing apparatus typically comprises a cylinder of breathable gas mounted on a harness carried by the user, and a delivery device, such as a mask, that supplies the breathable gas to the user. A pressure gauge, such as a manual gauge or a digital gauge, can be provided so that the wearer can monitor the amount of breathable gas remaining in the cylinder.

A mobile monitoring unit such as a PASS (Personal Alert Safety System) (which may also be known as an Automatic Distress Signal Unit or "ADSU") is often used with breathing apparatus and in some cases is required by law. A PASS comprises a motion sensor that monitors the motion of the wearer and an alarm, for example an audible or visual alarm that is activated if motion is not detected for a pre-determined period of time. If no motion is detected it may indicate that the wearer is injured or incapacitated and therefore the alarm may alert rescue personnel to the location of the wearer.

In some cases, a PASS is integrated with the breathing apparatus, such that the wearer of the breathing apparatus is automatically provided with a PASS when they are wearing breathing apparatus. However, it may be desirable to provide a PASS which is linked to, or 'owned' by, a particular individual. To enable this with integral PASS devices, each individual must always use the same breathing apparatus or the integral PASS of a breathing apparatus must be repeatedly re-calibrated to link it to the particular individual wearing the breathing apparatus.

SUMMARY OF THE INVENTION

It is therefore desirable to provide improvements in the field of monitoring a wearer of breathing apparatus.

According to an aspect, there is provided a portable monitoring unit for personnel working in hazardous environments, comprising a coupling to which an auxiliary unit can be structurally coupled; a motion sensor; an alert generator which is configured to generate an alert when motion is not detected for a period of time; and a power interface arranged to receive power for the portable monitoring unit from a power interface of the auxiliary unit when the auxiliary unit is structurally coupled to the portable monitoring unit.

The portable monitoring unit may provide the advantage that the same portable monitoring unit may be utilised with multiple different auxiliary units. Accordingly, the portable monitoring unit may be linked to a particular individual user, and may be coupled and decoupled different auxiliary units suitable to differing activities that the individual user undertakes.

For example, when first responding to a fire, an emergency worker may couple their portable monitoring unit to a self-contained breathing apparatus (SCBA) so that they can approach the fire to extinguish it. At a later time, after the fire is extinguished, the same emergency worker may wish to re-enter the location of the fire but an SCBA may no longer be required. In this case, the portable monitoring unit may be decoupled from the SCBA and re-coupled to another auxiliary unit, such as a battery pack or a more light-weight breathing apparatus.

As the portable monitoring unit may be powered from the auxiliary unit, the portable monitoring unit may be made lighter and smaller than otherwise possible such that its coupling and de-coupling from a range of different auxiliary units can be achieved quickly and more simply. Furthermore, with a power supply provided by an auxiliary unit, there may be a reduced risk that a power supply internal to the portable monitoring unit could fail, rendering the motion sensor inoperable and endangering the user.

The portable monitoring unit may be a PASS (Personal Alert Safety System) or an ADSU (Automatic Distress Signal Unit). The portable monitoring unit may be for a breathing apparatus, in particular a self-contained breathing apparatus. The portable monitoring unit may comply with the requirements of JCDD/38 and/or BS10999 and/or NFPA 1982. The portable monitoring unit may enter a pre-alert mode when motion is not detected for a period of time. It may be possible to cancel this pre-alert mode manually by movement or by pressing a manual button on the portable monitoring unit. If the pre-alert mode is not cancelled, and motion is not detected for a further period of time, the portable monitoring unit may enter a full-alert mode, which may comprise visual and/or audible signals. The alert may comprise an instruction to enter the pre-alert mode. The portable monitoring unit may comprise a transmitter for transmitting the alert to a remote receiver. The remote receiver may be a central monitoring device in communication with one or more portable monitoring units.

The coupling of the portable monitoring unit may be a part to which a coupling of the auxiliary unit can be coupled, or may be a part which couples to a coupling of an auxiliary unit. The coupling may enable the portable monitoring unit to be supported by the auxiliary unit or for the portable monitoring unit to support the auxiliary unit.

The motion sensor may be for detecting motion or movement of the portable monitoring unit. The motion sensor may be an accelerometer, a gyroscope, an inertia sensor, or any other sensor capable of detecting motion.

The alert generator may comprise a sound generator for generating an alarm sound, such as a loudspeaker. The alert generator may comprise an alert transmitter for transmitting an alert. The alert may be transmitted to a remote receiver. The remote receiver may be a monitoring system, such as a control board or telemetry system for monitoring one or more emergency personnel. The alert generator may comprise a light generator for generating alarm lighting. The alarm lighting may be visually distinctive to enable the portable monitoring unit to be located in low-visibility environments and/or in loud environments where the sound generator may be ineffective or not operational.

The coupling may be a mechanical coupling. The coupling may be manually releasable. The coupling may be configured to resist decoupling of the portable monitoring unit and the auxiliary unit when coupled. The portable monitoring unit or the auxiliary unit may comprise a retaining feature, such as a fastener for fastening the portable monitoring unit to the auxiliary unit. The fastener may comprise a threaded element, such as a bolt or screw, which engages a complimentary feature, such as a threaded hole, on the auxiliary unit. Alternatively, the fastener may be provided on the auxiliary unit to engage with a complimentary feature on the portable monitoring unit. A seal may be provided to prevent ingress of moisture, dust, and other contaminants at the interface between the portable monitoring unit and the auxiliary unit.

The auxiliary unit may be detachably coupled to the coupling. The coupling may comprise a release mechanism. The release mechanism may require activation to enable decoupling of the portable monitoring unit and the auxiliary unit. For example, the release mechanism may be one or more over-centre clips and/or one or more threaded connections.

The portable monitoring unit may comprise a first housing. The auxiliary unit may comprise a second housing. Outer profiles of the first and second housings substantially conform. The first and second housings may substantially conform to prevent or diminish ingress of unwanted substances at the interface between the portable monitoring unit and the auxiliary unit. The conforming of the first and second housings may give the units, when coupled, the appearance of a single contiguous component, which may deter theft or tampering with the coupling therebetween. Furthermore, the conforming of the first and second housings may provide an ergonomic portable monitoring unit which may be easier to handle and operate.

The power interface of the portable monitoring unit may comprise terminals. The terminals of the portable monitoring unit may be for contact with terminals of the power interface of the auxiliary unit to provide an electrical connection therebetween.

The power interface of the portable monitoring unit may comprise a wireless power receiver. The power interface of the auxiliary unit may comprise a wireless power transmitter. The wireless power receiver and/or transmitter may be operable to transmit power to the portable monitoring unit by inductive coupling, capacitive coupling, or magnetodynamic coupling.

The portable monitoring unit may further comprise a temporary power supply for powering the portable monitoring unit when an auxiliary unit is not coupled to the portable monitoring unit. The temporary power supply may enable the portable monitoring unit to remain operational while being transferred between different auxiliary units, or may enable the portable monitoring unit to be used in a standalone mode while not coupled to an auxiliary unit.

The portable monitoring unit may further comprise a display for displaying data. The display may be visually distinctive such that it may be read in low light environments. The display may be backlit or luminescent. The data may comprise an alert status of the portable monitoring unit. The data may comprise data outputted by the motion sensor or the alert generator.

The portable monitoring unit may further comprise a data interface for receiving data from a data interface of the auxiliary unit. The received data may be displayed on the display.

The received data may comprise pressure data indicative of a fill level of a vessel of breathable gas. The received data may comprise a predicted remaining time before a vessel of breathable gas reaches a predetermined level. The predetermined level may be empty, or a level at which a predetermined amount of breathable gas remains, such as an amount of breathable gas providing a predetermined remaining breathing time for the user.

The received data may comprise a power level of a power supply of the auxiliary unit. The received data may be a predicted remaining power supply or predicted remaining operating time of the portable monitoring unit.

The auxiliary unit may be a battery pack. The battery pack may comprise a plurality of battery cells. The battery pack may be rechargeable. The battery pack may have a first power capacity. The auxiliary unit may be a further battery pack. The further battery pack may have a second power capacity different to the first power capacity. The battery pack may comprise a sensor for measuring a power level of the battery. The sensor may output battery data indicative of a power level of the battery or of a remaining operating time of the battery or the portable monitoring unit. The battery data may be displayed on the display. A number of different auxiliary units may be provided for connection to the portable monitoring unit.

The auxiliary unit may be a docking unit which is connected to a breathing apparatus. The docking unit may be arranged on a flexible appendage, such as a gauge hose or gauge cable, of a breathing apparatus or, in particular, proximate a free end of the flexible appendage. The docking unit may be arranged on a shoulder strap of the breathing apparatus, or on the waist belt of a breathing apparatus.

The docking unit may be connected to a power supply. The power supply may be a mains power supply or a battery power supply.

The docking unit may be connected to a further auxiliary unit. The further auxiliary unit may be a battery pack.

The docking unit may be connected to a pressure transducer. The pressure transducer may be arranged to measure a pressure of a vessel of breathable gas. The pressure transducer may output pressure data indicative of a fill level of a vessel of breathable gas. More than one vessel of breathable gas may be provided. A single pressure transducer may measure the pressure of all vessels of breathable gas, or a pressure transducer may be provided for each vessel of breathable gas.

According to a further aspect, there is provided an apparatus comprising a portable monitoring unit and an auxiliary unit structurally coupled to the portable monitoring unit. The auxiliary unit may be removably coupled to the portable monitoring unit.

The portable monitoring unit may have any features of the portable monitoring units herein described. The auxiliary unit may have any features of the auxiliary units herein described.

According to a further aspect, there is provided a kit of parts comprising a portable monitoring unit and a plurality of different auxiliary units, wherein each auxiliary unit can be individually structurally coupled to the portable monitoring unit. The plurality of auxiliary units may be removably coupled to the portable monitoring unit interchangeably. In some examples, only one auxiliary unit may be coupled to the portable monitoring unit at any time. In other examples, more than one auxiliary unit may be coupled to the portable monitoring unit, or a further auxiliary unit may be coupled to an auxiliary unit coupled to the portable monitoring unit.

The portable monitoring unit may have any features of the portable monitoring units herein described. Each of the plurality of different auxiliary units may have any features of the auxiliary units herein described.

The invention may comprise any combination of the features and/or limitations referred to herein, except combinations of such features as are mutually exclusive.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
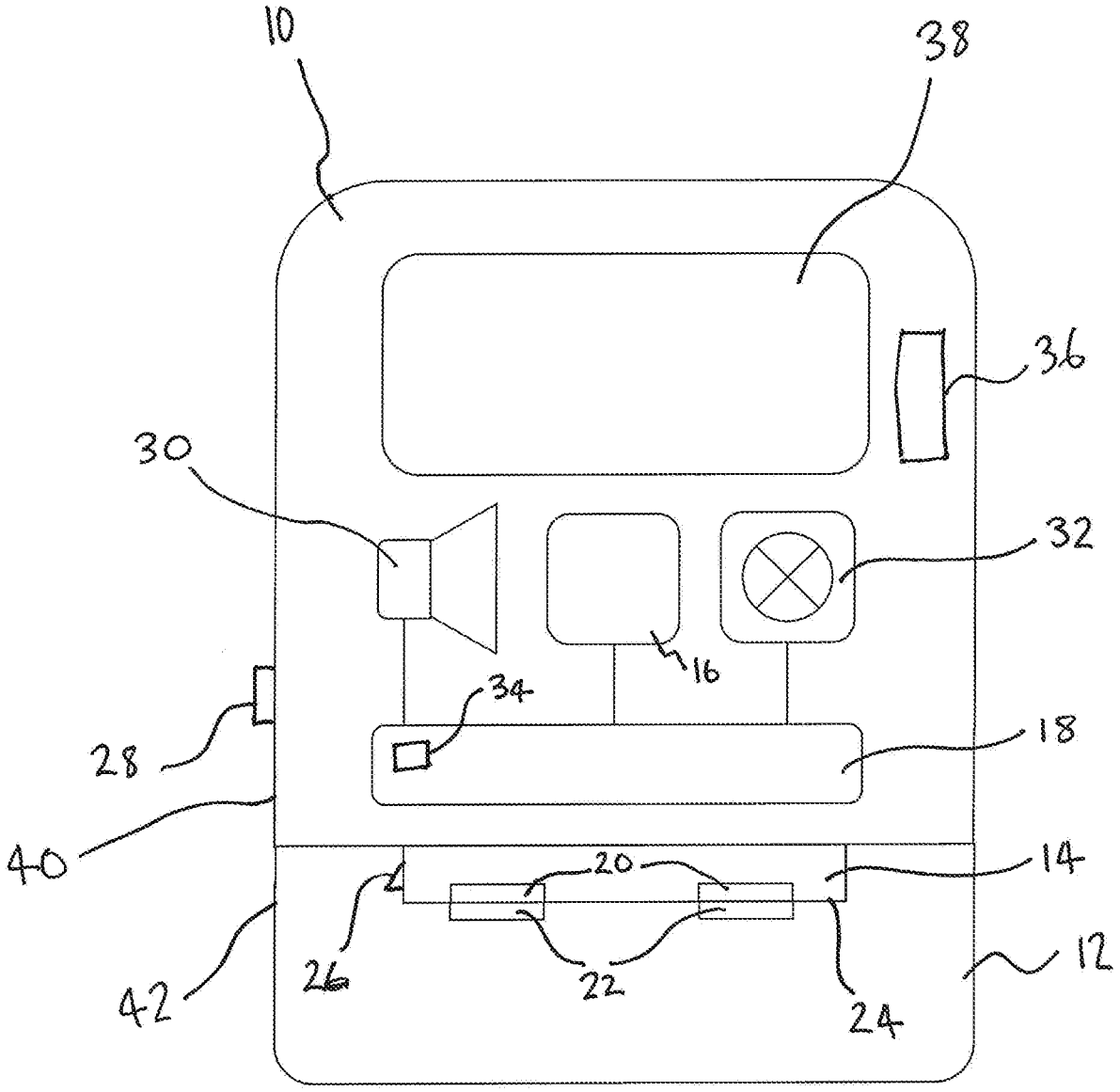
FIG. 1 schematically shows a portable monitoring unit and a battery pack.

FIG. 1 shows a portable monitoring unit 10 and an auxiliary unit 12. In this example, the auxiliary unit 12 is a battery pack 12. The portable monitoring unit 10 may be referred to as a PASS (Personal Alert Safety System) or ADSU (Automatic Distress Signal Unit).

A primary function of the portable monitoring unit 10 is to provide an alert when it is to provide an alert or alarm when motion is not detected for a pre-determined period of time. The unit 10 is typically connected to an emergency worker, either by a clip, not shown, or by being attached to a breathing apparatus worn by the worker. Accordingly, as the worker moves, the unit 10 also moves and this motion is detected. If motion is not detected by the unit 10 for a pre-determined period of time, then this may be indicative that the worker is incapacitated or otherwise injured, so the unit 10 is operable to generate an alert to indicate that the worker may need to be rescued.

To this end, the portable monitoring unit 10 comprises a motion sensor 16 and an alert generator 18. In normal operation, the motion sensor 16 is capable of detecting motion of the portable monitoring unit 10. When motion is detected by the motion sensor 16, a signal indicative that motion is occurring is sent to the alert generator 18. In other examples, no signal may be sent by the motion sensor 16 when it senses that motion is occurring or has recently occurred within a pre-determined period of time. However, when the motion sensor 16 does not detect motion for the pre-determined period of time, then a signal indicative that no motion has been detected during a pre-determined period is sent by the motion sensor 16 to the alert generator 18.

In order to prevent false alarms of worker incapacitation, when the alert generator 18 receives a signal from the motion sensor 16 that no motion has occurred for the pre-determined period, then the unit 10 enters a 'pre-alert' mode. In this pre-alert mode, the unit 10 provides a local alert to the worker that it will shortly enter a 'full alert' mode if no motion is detected within a further pre-determined period of time. Thus, if the worker is not incapacitated and has merely remained still for another reason, then they can move the unit 10 during pre-alert mode (for example by shaking it) to cancel the alert and prevent the unit from entering full alert mode.

In order to provide the local pre-alert warning to the worker, the unit 10 comprises a speaker 30 and a light 32. In pre-alert, the speaker 30 and light 32 may generate sound and light to indicate to the worker that pre-alert mode has been entered due to no motion being detected. Accordingly, the worker can then take preventative action to avoid a full alert occurring.

During pre-alert mode, if the motion sensor 16 does not detect motion for a further pre-determined period, then the motion sensor 16 sends a signal to the alert generator 18 and the alert generator 18 puts the unit 10 into full alert mode. In full alert mode, the alert generator may change or increase the intensity of the alerts generated by the speaker 30 and light 32 to provide an indication of the location of the worker wearing the unit 10. The alert generator 18 may comprise a transmitter 34 for transmitting an alert signal to a remote device, such as a control board, to indicate that full alert mode has been entered for the unit 10 and to provide the location of the unit 10. Accordingly, other workers may be able to locate and rescue the worker wearing the unit 10.

In some examples, the transmitter 34 may also transmit an indication to a remote device when the unit enters pre-alert mode.

In the example of FIG. 1, the portable monitoring unit is coupled to a battery pack 12, which provides power for the operation of the portable monitoring unit 10. Therefore, the unit 10 can be used as a standalone device which may be worn by an emergency worker, for example with a clip provided on the unit 10 (not shown).

In order to couple the portable monitoring unit 10 to the battery pack 12, the unit 10 comprises a coupling 14 to which battery pack 12 is structurally coupled. As shown in FIG. 1, the coupling 14 of the portable monitoring unit 10 is a protruding element. The battery pack 12 comprises its own coupling 24 in the form of a cavity 24 having a shape corresponding to that of the coupling 14 of the portable monitoring unit 10.

Accordingly, when the coupling 14 is received into the cavity 24, the portable monitoring unit 10 is structurally coupled to the battery pack 12. The coupling comprises a retaining element 26 which engages with a complimentary feature of the battery pack 12 to retain the coupling in the cavity 24. The retaining element 26 is biased into and extended position, but is retracted during the insertion process. Once the coupling 14 is fully inserted into the cavity 24, the retaining element 26 is biased back into the extended position to retain the coupling 14 in the cavity 24.

When it is desired to de-couple the portable monitoring unit 10 from the battery pack 12, the retaining element 26 can be retracted back into the retracted position by depressing a button 28 of the portable monitoring unit 10. When the button 28 is depressed, the retaining element 26 no longer engages with the battery pack 12, and the coupling 14 can be removed from the cavity 24 to decouple the unit 10 and the battery pack 12.

In other examples, the retaining element 26 may be replaced or supplemented by another form of retaining feature. For example, a removable screw or bolt provided on either the portable monitoring unit 10 or the auxiliary unit 12 may removable secure the units 10 and 12 together. A clip mechanism, such as an over-centre clip may also releasably connect the units 10 and 12.

In other examples, other couplings may be provided to couple the portable monitoring unit 10 and the battery pack 12. It should be understood that many other types of coupling may be suitable to structurally couple the portable monitoring unit 10 to an auxiliary unit. For example, the coupling 14 of the portable monitoring unit may comprise a cavity or slot into which a part of the auxiliary unit may be retainably received. Structural coupling may require that the portable monitoring unit 10 and the auxiliary unit are coupled together in such a way that the coupling resists or prevents separation of the two units when coupled.

The portable monitoring unit 10 also comprises a power interface 20 in the form of terminals 20. When the portable monitoring unit 10 is structurally coupled to the auxiliary unit 12, the power interface 20 of the portable monitoring unit 10 receives power for the unit 10 from a power interface 22 of the auxiliary unit 12. In this example, the power interface 20 is located on the coupling 14, but in other examples, the power interface 20 may be located elsewhere on the portable monitoring unit. In some examples, the power interface of the portable monitoring unit 10 may be a wireless power receiver and the power interface of the auxiliary unit 12 may be a wireless power receiver. In this example, a temporary power supply 36 is provided as part of the portable monitoring unit 10 for powering the portable monitoring unit 10 when it is not coupled to an auxiliary unit. The temporary power supply 36 may have a power capacity significantly smaller than that of the battery pack 12.

The portable monitoring unit 10 further comprises a display 38. The display 38 can display data relating to the current mode of the portable monitoring unit 10, such as normal, pre-alert, or full alert. The display 38 may display a power level of the battery pack 12, or a remaining operating time based upon a remaining power level of the battery pack 12. The display 38 may also display data relating to a fill level of a vessel of breathable gas (not shown) which may be transmitted to the unit 10 by either wired or wireless means.

The display 38 may also display data relating to other portable monitoring units which are in the vicinity of the portable monitoring unit 10. For example, if a nearby worker is also wearing a portable monitoring unit 10 which enters pre-alert or full alert, then a signal may be received by other portable monitoring units 10 nearby to indicate to other workers that one of their colleagues may be in danger.

It should be understood that the display 38 is suitable for displaying many types of data which may be required by an emergency worker.

The portable monitoring unit 10 comprises a housing 40 and the battery pack 12 comprises a housing 42. When the portable monitoring unit 10 and the battery pack 12 are coupled, the outer profiles of the housings 40, 42 substantially conform. Therefore, when the battery pack 12 is coupled to the unit 10, they have the appearance of a contiguous device. Accordingly, an interface or gap between the unit 10 and the battery pack 12 may be minimised or sealed to prevent the ingress of particles or liquids, such as those which may affect the operation of the coupling 14 or the power interfaces 20, 22. A sealing element may be provided on either or both of the units 10.

Figure 2:
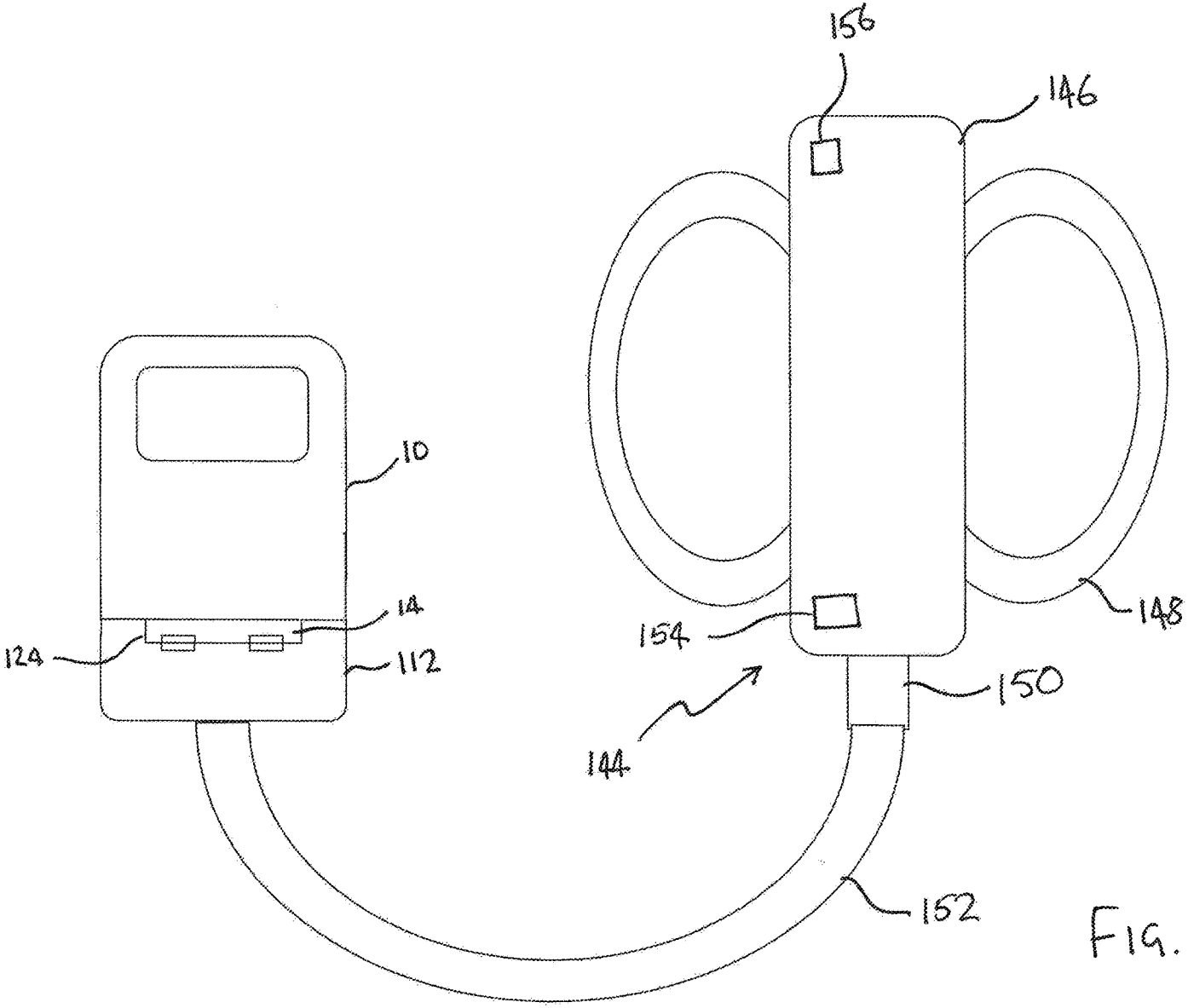
FIG. 2 schematically shows a portable monitoring unit and a breathing apparatus.

FIG. 2 shows the portable monitoring unit 10 as described and illustrated in FIG. 1 coupled to an auxiliary unit 112 in the form of a docking unit 112. For ease of understanding, some features of the portable monitoring unit 10 have been omitted from FIG. 2. Nevertheless, it should be understood that portable monitoring unit 10 as illustrated in FIG. 2 may have some or all of the features described in relation to FIG. 1 above.

The docking unit 112 forms part of a breathing apparatus 144. The breathing apparatus comprises a vessel 146 containing a breathable gas supported on a harness 148 comprising shoulder straps. The breathing apparatus further comprises a valve apparatus 150 for controlling release of breathable gas from the vessel 146 to a worker's face mask (not shown). It should be understood that many types of breathing apparatus are available and other examples of breathing apparatuses may be compatible with the portable monitoring unit 10.

The breathing apparatus 144 further comprises an elongate flexible appendage in the form of a gauge hose or gauge cable 152. The gauge hose 152 may be secured to the harness 148 such that it conforms to one of the shoulder straps to hang over the shoulder of the user, or it may be left to hang freely. The docking unit 112 is provided at a free end of the gauge hose 152. The docking unit comprises a coupling 124 of a similar type to the coupling 24 of the battery pack 12 of FIG. 1. Accordingly, the portable monitoring unit 10 can be structurally coupled to the docking unit 112 such that the portable monitoring unit is supported on the breathing apparatus 144 by the gauge hose 152. In other examples, the docking unit 112 may be provided on the harness 148 of the breathing apparatus 144, such as on a shoulder strap or a waist belt.

The breathing apparatus 144 further comprises a power supply 154. The power supply 154 may be a battery pack or a connection to a mains power supply. The power supply 154 provides power to the portable monitoring unit 10 via the docking unit 112. In this example, the gauge hose 152 comprises power transmission cables for providing power to the docking unit 112.

The breathing apparatus 144 also comprises a pressure transducer 156 for measuring a pressure of the vessel 146 of breathable gas. The pressure transducer 156 may provide pressure data indicative of a fill level of the vessel, which may also be indicative of a remaining time of breathable gas supply for a worker. Data from the pressure transducer 156 may be transmitted to the portable monitoring unit 10 via the docking unit 112 and may be displayed on the display of the portable monitoring unit 10. In some cases, the power interfaces 20, 22 may also be data interfaces for providing data to the portable monitoring unit 10 to be shown on the display 38.

Although it has been described that the harness is for self-contained breathing apparatus, in other embodiments it could be a harness for other types of breathing apparatus.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. An apparatus comprising:

a portable monitoring unit for personnel working in hazardous environments; and a plurality of different auxiliary units which may be coupled to the portable monitoring unit, the portable monitoring unit comprising:

a coupling to which a plurality of different auxiliary units may be individually structurally coupled and decoupled;

a motion sensor for detecting motion of personnel, and activating a pre-alert mode if motion is not detected for a first period of time;

an alert generator which is configured to generate an alert when motion is not detected for a period of time; and a power interface arranged to receive power for the portable monitoring unit from a corresponding power interface of one of the plurality of different electric auxiliary units, when said one of the plurality of different electric auxiliary units is individually structurally coupled to the portable monitoring unit, wherein the plurality of different electric auxiliary units comprise at least a first battery pack and a first docking unit for a self-contained breathing apparatus.

2. The apparatus as claimed in claim 1, wherein the coupling is a mechanical coupling.

3. The apparatus as claimed in claim 1, wherein the said one electric auxiliary unit can be detachably coupled to the coupling.

4. The apparatus as claimed in claim 1, wherein the portable monitoring unit comprises a first housing and wherein the said one electric auxiliary unit comprises a second housing, wherein outer profiles of the first and second housings substantially conform.

5. The apparatus as claimed in claim 1, wherein the power interface of the portable monitoring unit comprises terminals or a wireless power receiver.

6. The apparatus as claimed in claim 1, further comprising a temporary power supply for powering the portable monitoring unit when an electric auxiliary unit is not coupled to the portable monitoring unit.

7. The apparatus as claimed in claim 1, further comprising a display for displaying data.

8. The apparatus as claimed in claim 1, further comprising a data interface for receiving data from a data interface of the auxiliary unit.

9. The apparatus as claimed in claim 8, wherein the received data comprises pressure data indicative of a fill level of a vessel of breathable gas.

10. The apparatus as claimed in claim 1, wherein the electric auxiliary unit is a battery pack.

11. The apparatus as claimed in claim 1, wherein the electric auxiliary unit is a docking unit which is connected to a breathing apparatus, optionally wherein the docking unit is connected to a power supply.

12. The apparatus as claimed in claim 11, wherein the docking unit is connected to a further electric auxiliary unit, optionally wherein the further electric auxiliary unit is a battery pack.

13. The apparatus as claimed in claim 11, wherein the docking unit is connected to a pressure transducer.

14. The apparatus as claimed in claim 1, wherein the motion sensor activates a full alert mode if motion of personnel is not detected for a second period of time which is longer than the first period of time set for activating the pre-alert mode.

15. The apparatus as claimed in claim 14, wherein the alert generator includes at least one selected from the group consisting of: a sound generator and a light generator.

16. The apparatus as claimed in claim 15, wherein the alert generator provides an alert indicating pre-alert mode has been entered.

17. The apparatus as claimed in claim 16, wherein the alert generator provides an alert indicating full alert mode has been entered.

18. The apparatus as claimed in claim 1, wherein the motion sensor is selected from the group consisting of: an accelerometer, a gyroscope, and an inertia sensor.

19. An apparatus comprising:

a portable monitoring unit; and a plurality of different electric auxiliary units, wherein each electric auxiliary unit can be individually structurally coupled to the portable monitoring unit, wherein at least two of the plurality of different electric auxiliary units comprise a battery pack and a docking unit for a self-contained breathing apparatus.

20. The apparatus as claimed in claim 19, further comprising a self-contained breathing apparatus coupled to the docking unit.

21. The apparatus as claimed in claim 19, wherein another of the plurality of different electric auxiliary units comprises a light-weight breathing apparatus.

22. The apparatus as claimed in claim 19, wherein the plurality of different electric auxiliary units are suitable for a plurality of different personnel activities, wherein such different personnel activities comprise one selected from the group of: hazardous investigations and non-hazardous investigations.

* * * * *